US007388549B2

(12) United States Patent
Chiang

(10) Patent No.: US 7,388,549 B2
(45) Date of Patent: Jun. 17, 2008

(54) MULTI-BAND ANTENNA

(76) Inventor: Kuo Ching Chiang, 4F, No. 14 Chungpu 6 street, Taoyuan City, Taoyuan Hsien (TW)

( * ) Notice: Subject to any disclaimer, the term of this patent is extended or adjusted under 35 U.S.C. 154(b) by 0 days.

(21) Appl. No.: 10/900,766

(22) Filed: Jul. 28, 2004

(65) Prior Publication Data

US 2006/0022880 A1 Feb. 2, 2006

(51) Int. Cl.
*H01Q 1/32* (2006.01)

(52) U.S. Cl. ..... 343/713; 343/711; 29/600

(58) Field of Classification Search ..... 343/711, 343/713; 29/600
See application file for complete search history.

(56) References Cited

U.S. PATENT DOCUMENTS 3,728,732 A * 4/1973 Igarashi ..... 343/713
3,773,684 A * 11/1973 Marks ..... 252/583
4,757,322 A * 7/1988 Yokogawa et al. ..... 343/712
5,005,020 A * 4/1991 Ogawa et al. ..... 343/713
5,083,135 A * 1/1992 Nagy et al. ..... 343/713
5,112,403 A * 5/1992 Okura et al. ..... 106/418
6,104,349 A 8/2000 Cohen ..... 343/702
6,266,023 B1 * 7/2001 Nagy et al. ..... 343/713
6,595,426 B1 * 7/2003 Brunet et al. ..... 235/487
6,760,593 B1 * 7/2004 Driessen ..... 455/500
6,802,205 B2 * 10/2004 Barguirdjian et al. ..... 73/73
6,846,566 B2 * 1/2005 Seo ..... 428/403
6,864,840 B2 * 3/2005 Zhu et al. ..... 343/700 MS
2003/0156070 A1 * 8/2003 Ooe et al. ..... 343/713
2003/0160723 A1 * 8/2003 Cohen ..... 343/700 MS
2006/0016097 A1 * 1/2006 Chiang ..... 34/549

* cited by examiner

*Primary Examiner*—Trinh V Dinh
(74) *Attorney, Agent, or Firm*—Kusner & Jaffe

(57) ABSTRACT

The present invention discloses a method of forming a multi-band antenna, especially the fractal antenna which allows a convenient reception of single for communication. The multi-band behavior is obtained by a set of geometry patterns of the same basic elements. The antenna is formed by preparing coating particles including particles, silica, and a solvent. Heating the metallic particles, the silica particles and the solvent at a temperature higher than about 100 degrees C. to from a coating solution. An additional passive layer can be added to protect the conducting layer of the antenna. Materials for this passive layer are made, for instance, of oxide.

12 Claims, 8 Drawing Sheets

Z

MULTI-BAND ANTENNA

FIELD OF THE INVENTION

The present invention relates an antenna, and more particularly, a multi-band transparent antenna coated on an object.

BACKGROUND OF THE INVENTION

Recently, the wireless telecommunication is wide spread in the world. Most of the wireless devices such as portable phone, personal assistance and digital television need the receiving apparatus to receive the transmission signal. Owing to digitization of information signals, various types of information such as audio information, image information, etc. can be easily handled on personal computers, mobile devices, etc. Audio and image codec technologies are used to promote the band compression of these types of information. The digital communication and the digital broadcasting are creating an environment to easily and efficiently deliver such information to various communication terminal devices. For example, audio video data (AV data) can be received on a portable telephone.

The wireless communication module is attached to or detached from the main device via the connector to store data and the like supplied from the main device in the flash memory element and transfer data and the like stored in the flash memory element to the main device. When attached to the main device, the wireless communication module uses the externally protruded antenna section to enable wireless interchange of signals between the main device and a host device or a wireless system. RF circuits, transmission lines and antenna elements are commonly manufactured on specially designed substrate boards. For the purposes of these types of circuits, it is important to maintain careful control over impedance characteristics. Electrical length of transmission lines and radiators in these circuits can also be a critical design factor. Two critical factors affecting the performance of a substrate material are dielectric constant (sometimes called the relative permittivity) and the loss tangent (sometimes referred to as the dissipation factor). The relative permittivity determines the speed of the signal in the substrate material, and therefore the electrical length of transmission lines and other components implemented on the substrate. The loss tangent characterizes the amount of loss that occurs for signals traversing the substrate material. Losses tend to increase with increases in frequency.

Printed transmission lines, passive circuits and radiating elements used in RF circuits are typically formed in one of three ways. One configuration known as micro-strip, places the signal line on a board surface and provides a conductive layer, commonly referred to as a ground plane. A second type of configuration known as buried micro-strip is similar except that the signal line is covered with a dielectric substrate material. In a third configuration known as strip-line, the signal line is sandwiched between two electrically conductive (ground) planes. The antenna is patterned on a principal plane of the printed circuit board. For vehicle application, the most common solution for these systems is the typical whip antenna mounted on the car roof. The current tendency in the automotive sector is to reduce the aesthetic and aerodynamic impact due to these antennas by embedding them in the vehicle structure. Also, a major integration of the several telecommunication services into a single antenna would help to reduce the manufacturing costs.

Some references related to the antenna configuration, for example: A design optimization methodology for multi-band stochastic antennas, P. L. Werner et al., 2002 IEEE, pp. 354-357. Hexagonal Fractal Multi-band Antenna, Philip Tang, 2002, IEEE, 554-556. Compact Multi-band Planar Antenna for Mobile Wireless Terminals, Zygmond Turski et al., IEEE, 2001, pp. 454-457. Trapezoidal Sierpinski Multi-band Fractal Antenna With Improved Feeding Technique, C. T. P. Song, IEEE, Transaction on Antenna and Propagation, vol. 5, No. 5, May 2003, pp, 1011-1017. Design of an Internal Qual-Bend Antenna for Mobile Phone, Pascal Ciais et al., IEEE, Microwave and Wireless Components Letters, vol. 14, No. 4, April, 2004, pp. 148-150. Design of a Multi-band Internal Antenna for Third Generation Mobile Phone Handsets, Mohammod Ali et al., IEEE, Transaction on Antenna and Propagation, vol. 51, No. 7, July 2003, pp, 1452-11461. Fractal Multi-band Antennas Based on Lotus-pods Patterns, Ji-Chyun Liu et al., Proceedings of APMC2001, Taipei, Taiwan, R. O. C., 2001 IEEE, pp. 1255-1258. Fractal Design of Multi-band and Low Side-Lobe Arrays, Carles Puente-Baliarda, IEEE, Transaction on Antenna and Propagation, vol. 44, No. 5, May 1996, pp, 730-739. U.S. Pat. No. 445,884 proposed to use the entire windshield conductive layer as impedance matching for FM band substantially horizontal antenna element. U.S. Pat. No. 6,300,914 proposed an antenna. some elementary forms of fractals. A base element is shown as a straight line, although a curve could instead be used. A so-called Koch fractal motif or generator is inserted into base element to form a first order iteration ("N") design, e.g., N=1. A second order N=2 iteration design results from replicating the triangle motif into each segment, but with reduced size. As noted in the Lauwerier treatise, in its replication, the motif may be rotated, translated, scaled in dimension, or a combination of any of these characteristics. A higher order pattern has been generated by including yet another rotation, translation, and/or scaling of the first order motif. One well known treatise in this field is Fractals, Endlessly Repeated Geometrical Figures, by Hans Lauwerier, Princeton University Press (1991), which treatise applicant refers to and incorporates herein by reference. U.S. Pat. No. 6,642,898 discloses a fractal cross slot broad band antenna comprising a radiating fractal cross slot layer having a plurality of antennas each comprising a plurality of radiating arms.

Obliviously some of the antenna configurations can only operate at a determinate frequency band in reason of the frequency dependence of the antenna parameter and are not suitable for a multi-operation. The material for the antenna is metal or alloy which will reduce the visibility if it formed on glass.

SUMMARY OF THE INVENTION

The present invention relates an antenna with the following parts and features. A transparent window is partially coated with a transparent conducting pattern. Two-conductor feeding transmission line and an impedance at the feeding point. The antenna is capable to receive at least one of the bands: FM, PHS, Wireless car aperture, GSM900, GSM1800, CDMA, GPRS, Bluetooth and WLAN, digital TV band.

The present invention disclosed an antenna comprising: a transparent conductive pattern formed on a glass, wherein the pattern includes antenna configuration; and a power source for moisture removal is coupled to the antenna configuration for providing heat or power to the transparent conductive pattern for removing fog, moisture on the glass.

The antenna configuration includes fractal antenna configuration such as Sierpinski pattern, koch pattern, Blackman-koch pattern, stochastic pattern, a set of hexagonal pattern, tree shape pattern or polygonal pattern. Further, the antenna configuration could be monopole or dipole antenna configuration. The antenna configuration includes trapezoidal planar antenna configuration.

The present invention discloses an antenna for an object comprising: at least one transparent conductive pattern attached at least partially on the object, wherein the transparent conductive pattern including an antenna configuration that is preferable to select one or more from fractal, planar, monopole and dipole antenna configuration. The object includes a vehicle windshield or a vehicle rearview mirror, wherein the transparent conductive pattern is attached at least partially the interior of the vehicle windshield or on the vehicle rearview mirror. Further, the object includes a substrate of a portable device. Wherein the object also includes, vehicle rear light, vehicle break light or vehicle headlight. The transparent conductive pattern includes oxide containing one or more following metal, wherein the metal is at least picked from Au, Ag, In, Ga, Al, Sn, Ge, Sb, Bi, Zn, Pt and Pd. The method for forming the conductive pattern comprises preparing a coating solution containing metal particles an then coating the solution on a substrate to form a layer; drying the layer; and baking the layer to obtain a transparent conductive pattern.

The present invention further discloses a conductive pattern comprising: a plurality of strips attached partially on an object, wherein the material for the conductive pattern includes oxide containing metal, the metal being preferable to select one or more metals from the aforementioned group, a power coupled to the conductive pattern for providing electrical current flowing through the conductive pattern to remove fog or moisture on the object. The object includes windshield of a vehicle, window, and rearview mirror of a vehicle, or glass, portable device such as cell phone, note book computer, personal data assistance and so on.

The advantage of the invention is the multi-band behavior of the antenna, especially the fractal antenna which allows a convenient reception of single for communication of the vehicle. The multi-band behavior is obtained by a set of geometry patterns of the same dimension. The transparent materials may be formed by sputtering vacuum deposition process. An additional passive layer can be added to protect the conducting layer. Materials for this passivation layer are made, for instance, of oxide, or any other polymeric material, polymer, resin coating on the structure. The method for forming the transparent conductive layer includes ion beam method at low temperature, see 1999, IEEE, 1191. U.S. Pat. No. 6,743,476 disclosed a method of producing thin film electrode at room temperature. Both of the ion beam and sputter is expensive. During the formation process, the present invention suggested that a mask can be placed on the substrate material to obtain the desired multi-band antenna shape. This mask normally is made of conducting material such as stainless steel or copper, or a photosensitive material to create the mask by photochemical processes. Then, the pattern can be "print" on the desired object. Thus, the expensive sputter process can be replaced by the chemical solution coating.

An antenna system includes a driven element, and at least one element a portion of which is a fractal element selected from a fractal counterpoise element. Wherein the fractal element is superposition over at least N=1 iterations of a fractal generator motif. An iteration is placement of the fractal generator motif upon a base figure through at least one positioning selected from the group consisting of (i) rotation, (ii) stretching, and (iii) translation.

DETAILED DESCRIPTION OF THE PREFERRED EMBODIMENTS

The present invention describes a multi-band antenna for vehicle or portable device. A configuration of the antenna pattern includes a set of polygonal elements, all of them of the same class (the same number of sides like), wherein the polygonal elements are electromagnetically coupled either by means of an ohmic contact or a capacitive or inductive coupling mechanism. The antenna configuration can be composed by whatever class of polygonal elements (triangle, square, pentagon, hexagon or even a circle or an ellipse in the limit case of infinite number of sides) as long as they are of the same class. The present invention differs from a conventional shape and the material to form the antenna. The antenna structure is easily identifiable and distinguished from a conventional structure by identifying the majority of elements and the material which constitute it. The main advantage addressed by fractal-shaped antennas antenna were a multi-frequency behavior, that is the antennas featured similar parameters (input impedance, radiation pattern) at several bands maintaining their performance. Also, fractal-shapes permit to obtain antenna of reduced dimensions compared to other conventional antenna. The antenna structure is based on multi-order structure with motif elements, such as polygonal structures, peak shape, circles, and tree shape. In the present invention, the concepts of fractals are applied in designing antenna elements and arrays. It is possible to use fractal structure to design small size, low profile, and low weight antennas. Most fractals have self-similarity, so fractal antenna elements or arrays also can achieve multiple frequency bands due to the self-similarity between different parts of the antenna. The combination of the infinite complexity and detail plus the self-similarity which are inherent to fractal geometry, makes it possible to construct smaller antennas with very wideband performance. A fractal loop antenna is about 5 to 10 times smaller than an equivalent conventional wideband low frequency antenna.

Figure 1A:
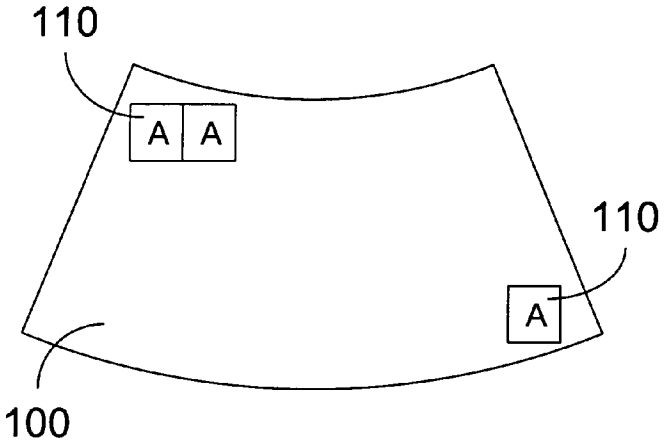
FIG. 1A describes a general example of the antenna attached on the windshield.
Figure 1B:
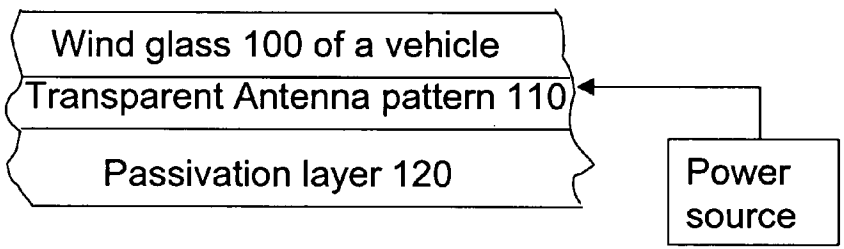
FIG. 1B illustrates the multilevel antenna formed between a substrate and passivation layer.
Figure 1C:
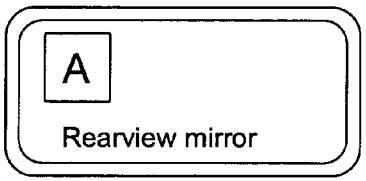
FIGS. 1C-1F illustrate the multilevel antenna formed on an object.
Figure 1D:
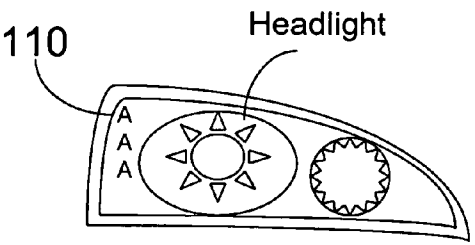
Figure 1G:
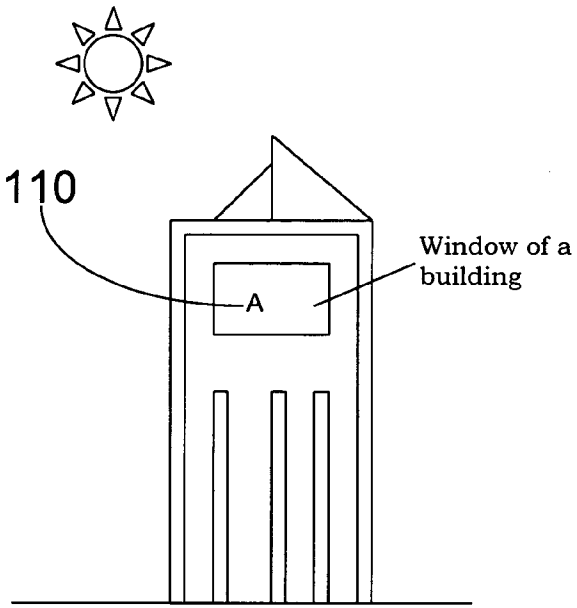
Figure 1E:
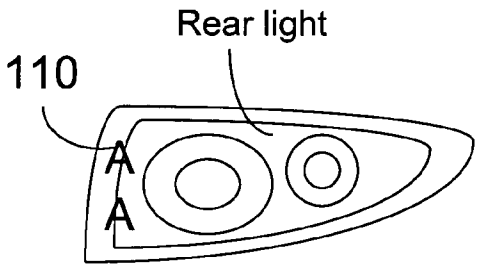
Figure 1F:
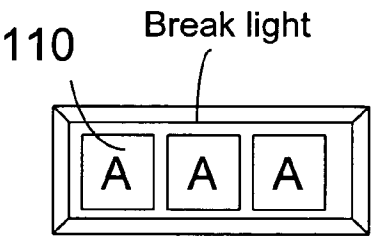
Figure 2A:
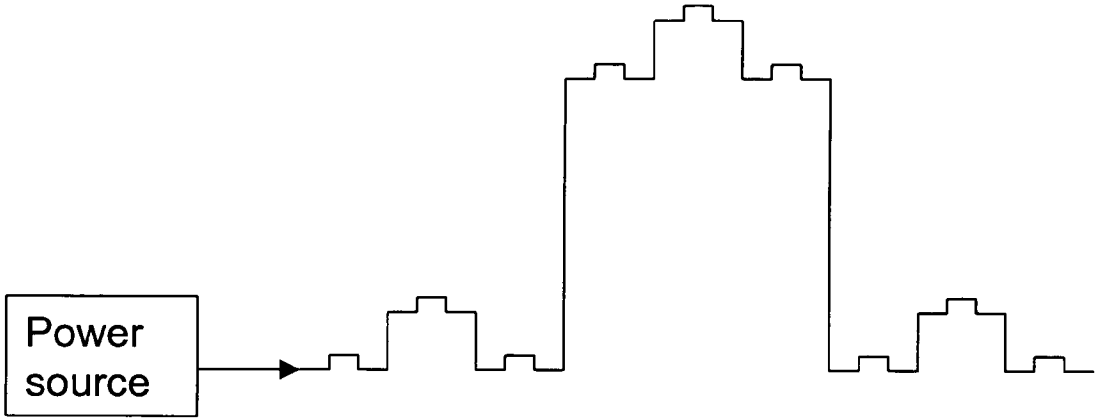
FIG. 2A: a rectangular multilevel structure as a monopole antenna.
Figure 2B:
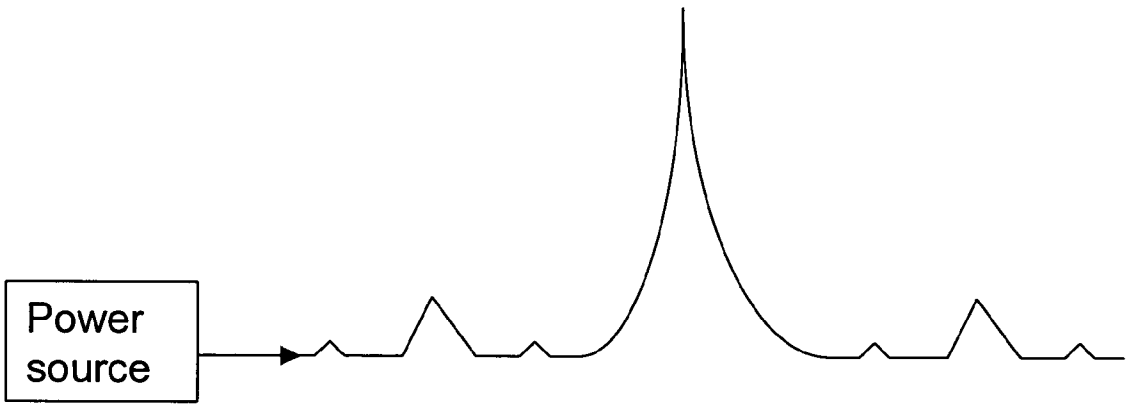
FIG. 2B: a peak shape as a motif element for multilevel structure.

FIGS. 1A and 1B describe a preferred embodiment of the present invention, the present invention comprising: a transparent conductive pattern 110 formed on an object 100, a passivation layer 12 is coated on the antenna pattern 110. One example of the object 100 is wind glass, rearview mirror of a vehicle (see FIG. 1C), window of a building (FIG. 1G), rear light of a vehicle (see FIG. 1E), vehicle head light (see FIG. 1D), rear light or vehicle break light (see FIG. 1F). It could also be formed in the rearview mirror encapsulate. The pattern includes an antenna configuration. In one example, a power source is optionally coupled to the antenna configuration for providing heat or power such that the transparent conductive pattern removes fog, moisture on the glass. The transparent antenna configuration includes fractal antenna configuration. As know in the art, the fractal configuration with a base element. A motif is inserted into the base element to form a first order. A second order iteration results from replicating the motif into each segment. The shape or the configuration of the fractal antenna pattern could include a koch pattern (FIG. 2A), Blackman-koch pattern (FIG. 2B), the main feature of the koch pattern is that each lobe of the curve is equal to the whole pattern. When the array radiates at a longer wavelength, the visible range is reduced and only a fraction of the whole array factor appears in the radiation pattern. The array has a similar radiation pattern at several bands, the pattern magnitude is reduced when the operating wavelength is increased. The modification of koch pattern is Blackman-koch pattern. In one example, the base element is rectangular shape. The motif is inserted into the rectangular shape to form a further order. A higher order iteration results from replicating the motif into each segment. Therefore, the Koch pattern is conformed with arrays constructed by interleaving hyperbolic distribution. The frequency reduction by a factor (⅓) would reduce the visible range around a secondary lobe which has the same shape as the whole pattern. An array factor for a set of bands spaced a factor of ⅓. The Blackman-koch pattern includes a peak shape motif. A second order iteration results from replicating the motif into each segment.

Figure 2C:
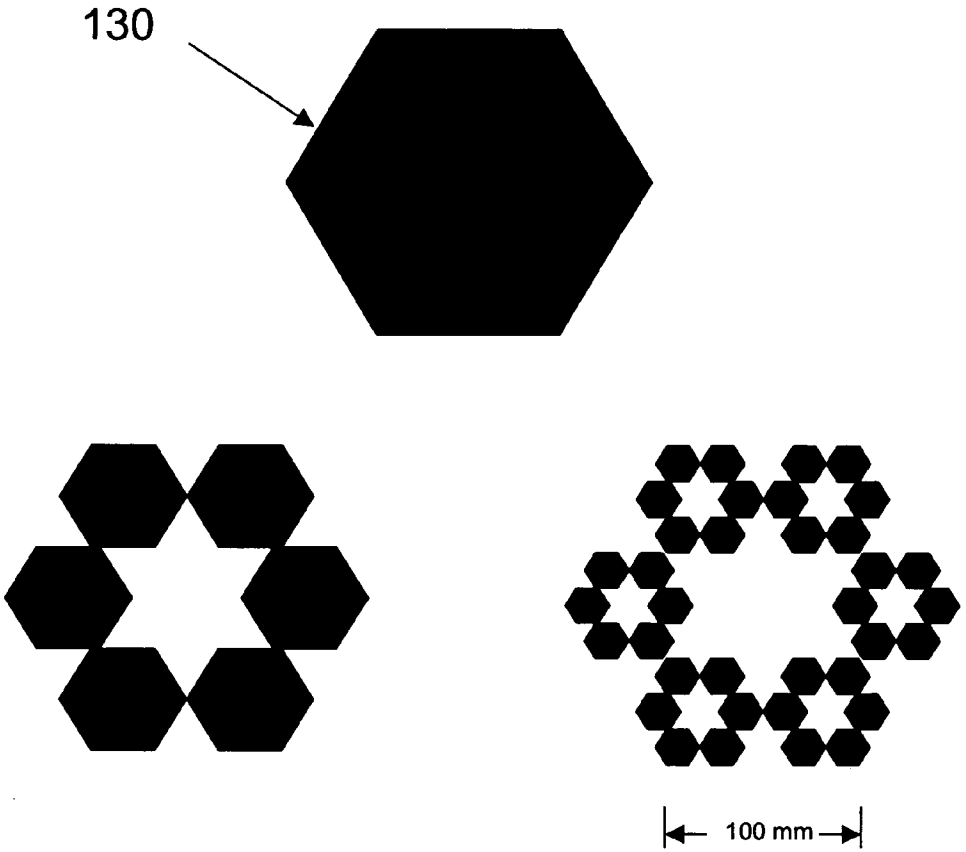
FIG. 2C: a hexagonal element as a motif element for multilevel structure.
Figure 2D:
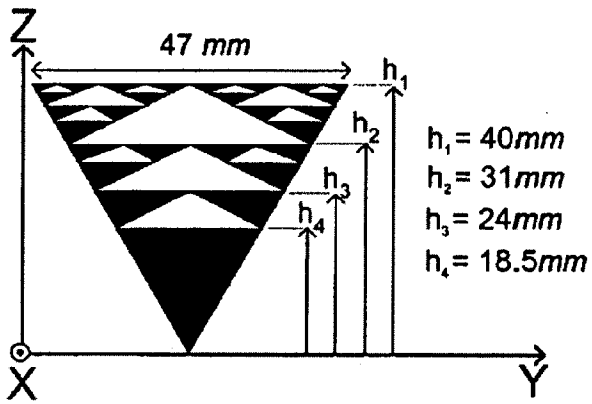
FIG. 2D: a triangle as a motif element for multilevel structure.
Figure 2E:
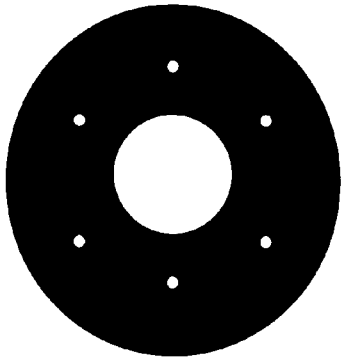
FIG. 2E: a circle as a motif element for multilevel structure.
Figure 2F:
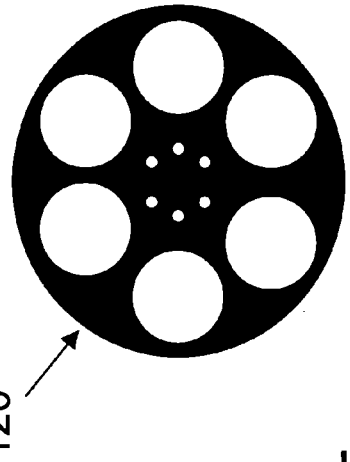
FIG. 2F: a stochastic pattern for multilevel structure.
Figure 2F:
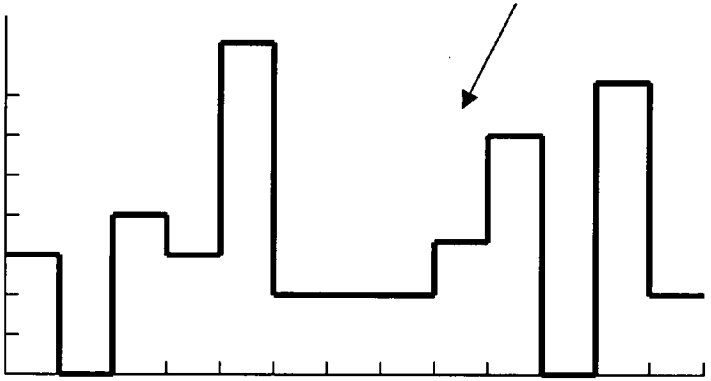
Figure 2H:
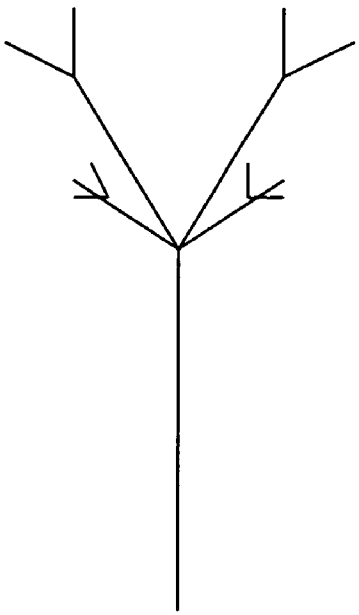
FIG. 2H illustrates the tree shape pattern.
Figure 2G:
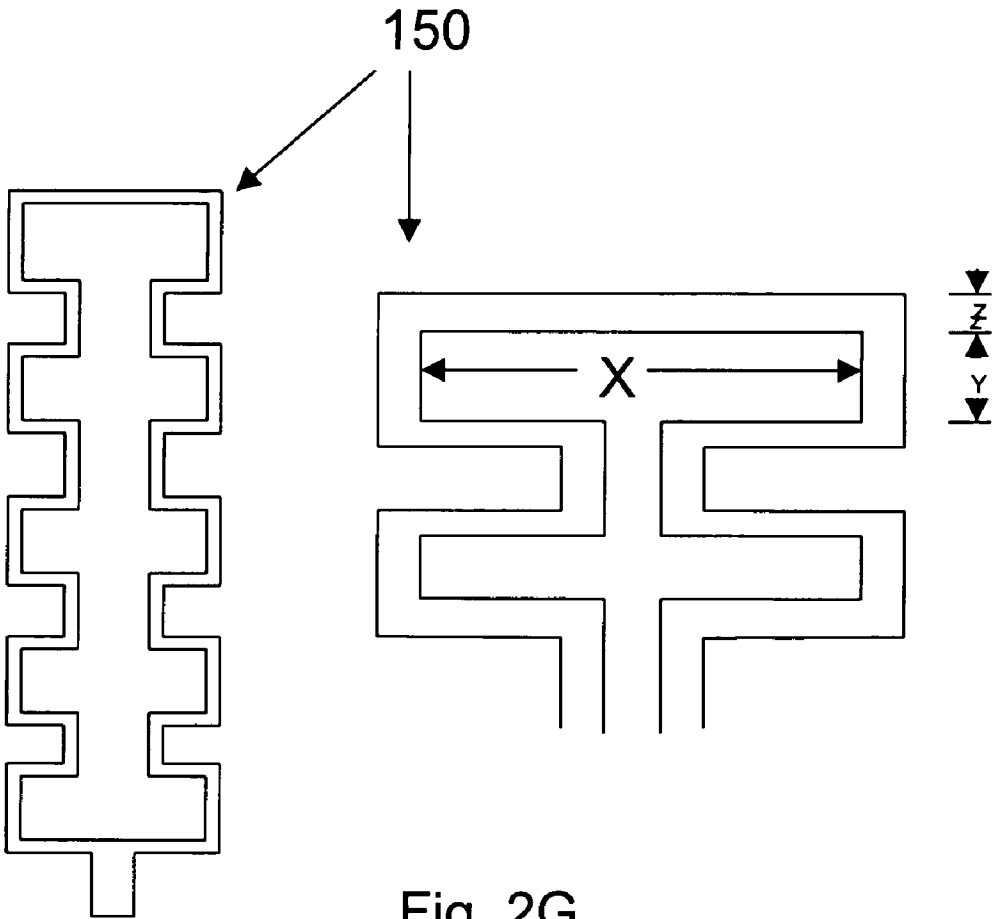
FIG. 2G illustrates the battlements shape antenna.
Figure 2I:
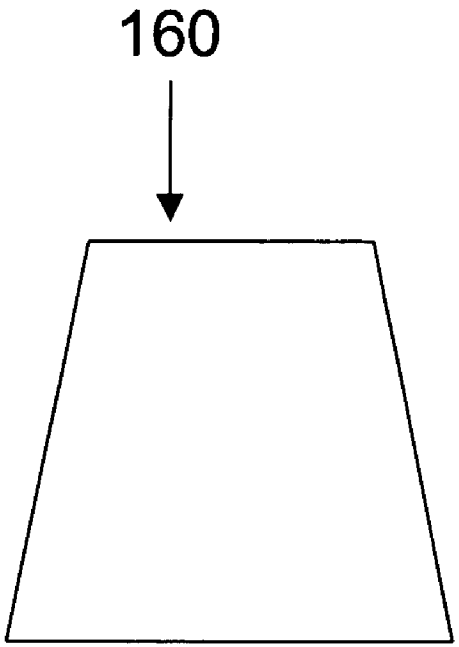
FIG. 2I illustrates the trapezoidal planar antenna configuration.

The shape or the configuration of the fractal antenna includes polygonal such as hexagonal pattern 130 (FIG. 2C), the hexagonal fractal antenna resonant frequencies repeat with a factor of three whereas the Sierpinski pattern fractal antenna resonant frequencies repeat with a factor of two. Hexagonal pattern 130 allows more flexibility in matching multi-band operation. Sierpinski pattern is shown in FIG. 2D. The antenna presented in FIG. 2D approximates the shape of a Sierpinski triangle. Since multi-scale levels are included in this example, this configuration assures a similar antenna behavior at multi-frequency bands. Lotus-pods Patterns 120 (FIG. 2E) is another embodiment. The pattern includes a disk with a plurality of circles formed therein. For example, six circles circularly tangent to each other with radius. The disk is the first generator whereas the smaller generator is constructed by the six circles constructing circular hexagon. From the figure, the pattern includes at least one kind of circles with one radius. Therefore, the Lotus-pods Patterns 120 are formed, in one example, the fractal scale is one third, and the multi-band response related to the iteration of fractal pattern is observed. The radius can be 65.2 mm. The antenna configuration could also be monopole or dipole antenna configuration. As shown in figure FIG. 2F, it illustrates a stochastic pattern 140. FIG. 2G illustrates the battlements shape antenna 150. The width of the battlements shape traces Z is about 1 mm, the width of one battlement (Y+2Z) is about 6 mm. The length of (X+2Z) is about 10 mm. The dimension is for example. The dipole antenna configuration includes tree shape pattern (FIG. 2H). The order of the fractal could be determined by desired. Planar antenna configuration is another option for the design. One possible example is trapezoidal planar antenna configuration 160 (FIG. 2I). The pattern may reduce the lost of the antenna and broaden the operating bandwidth.

Figure 2J:
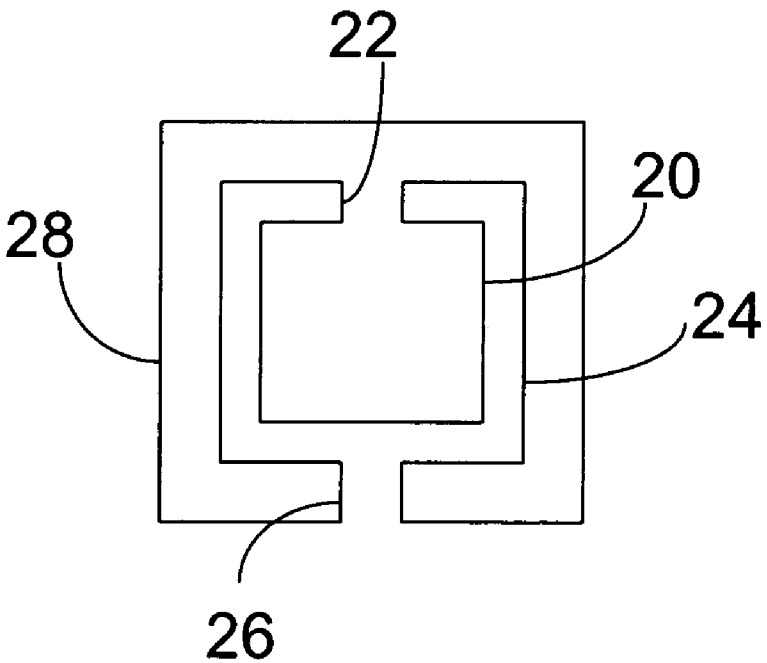
FIG. 2J illustrates the square antenna configuration.

In another one example (FIG. 2C), this configuration is composed by a set of hexagonal elements. One to 30 or more hexagonal elements are used and the antenna features a similar behavior at multi different frequency bands. The configuration is fed with a two conductor structure as well know in the art, with one of the conductors connected to the lower vertex of the multilevel structure and the other conductor connected to the metallic structure of the car. The contact can be made directly or using an inductive or capacitive coupling mechanism to match the antenna input impedance. The feeding conductor transmission line is formed with, for example, a 300 Ohms, a 50 Ohms or a 75 Ohms transmission line. An optically transparent conductive pattern is attached on a transparent substrate like the window of a building, rearview mirror, windshield a vehicle. Windshield or any vehicle windows in general is an adequate position to place this antenna such as vehicle windshield, a vehicle rearview mirror, vehicle rear light, vehicle break light or vehicle headlight. The antenna is useful for receiving the incoming signals that in a typically multi-band propagation environment. The antenna array is also a preferred arrangement. The present invention could be set on the window of a building to receive the communication signal. It may be coated on the glasses. Several multilevel structures can be printed with the same or different scheme described in any of the preceding configurations (FIGS. 2A-2J) or a combination of them, to form an antenna array or diversity scheme. The fractal multilevel structures are the same class with different size, scale or aspect ratio to tune the resonant frequencies to the several operating bands. The basic element of the multilevel antenna configurations includes line, polygonal structures (rectangular, hexagonal), peak shape, circles, and tree shape. Referring now to FIG. 2J, a fractal loop antenna includes a first substantially square shaped motif element 20 that is coupled to a second substantially square shaped motif element 22 via connection paths 24. The second substantially square shaped element 22 is also connected to a third substantially square shaped element 26 via connection paths 28. The pattern can be repeated indefinitely based on the number of loops.

The material for the conductive pattern includes oxide containing metal, wherein the metal can be selected one or more from Au, Ag, Pt, In, Ga, Al, Sn, Ge, Sb, Bi, Zn, and Pd. Some conductive materials formed by the method are transparent, if the antenna is attached on the glass or window, one may see through the window or glass. The antenna may also be attached on the light bulb cover of a vehicle. The transmittance of the cover is lower than the window, thus, the present invention may be formed on the light bulb cover of the vehicle. Alternately, the antenna could be formed on the cover, screen of the notebook, cell phone and so on.

In this case, the conductive layer, usually composed by a material includes oxide containing metal or alloy, wherein the metal is preferable to select one or more metals from Au, Zn, Ag, Pd, Pt, Rh, Ru, Cu, Fe, Ni, Co, Sn, Ti, In, Al, Ta, Ga, Ge and Sb. Some of the transparent material includes oxide containing Zn with Al2O3 doped therein. This shape is constructed by using an adequate mask during the forming process of the transparent conducting layer. In the case, the inner coaxial cable is directly connected to the element of the conductive layer, which can be optionally connected to the metallic body of the car. Other feeding configurations are possible such as by using a capacitive coupling. The feeding mechanism is well known in the art. The reception system can be improved by using space-diversity or polarization diversity techniques. Two or several multi-band antennas or an antenna array can be used. The advantage of using the techniques described in the present invention is that attaching a plurality of antennas in the same transparent window such that the diversity scheme can be included at a low cost. The feeding scheme is well known by those skilled in the art, other configurations of multi-band antennas can be used as well within the same scope and spirit of the present invention. From FIG. 2, multi-band antennas defined by the pattern are presented. In each figures, the antenna is represented in the different configurations. The polygon-based structure can be chosen as an alternative shapes whenever polarization diversity schemes are to be introduced to compensate the signal fading due to a rapidly changing propagation environment.

Figure 3:
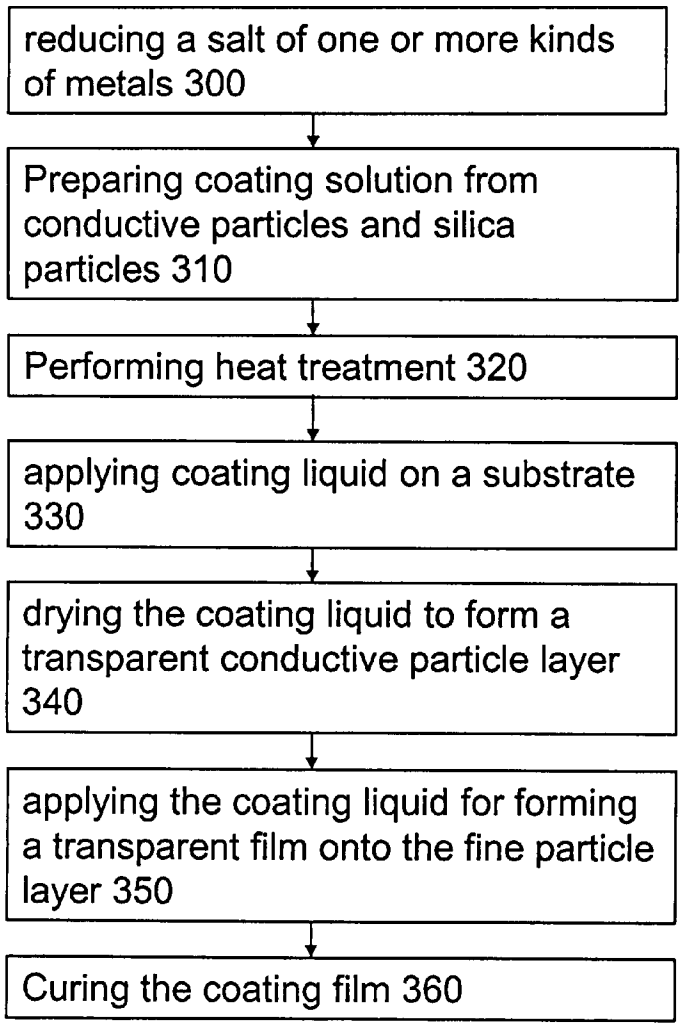
FIG. 3 shows the process flow of the present invention.

The method for forming the transparent conductive layer includes ion beam method for film formation at low temperature, for example, the film can be formed with receptivity lower than 3×10−4Ω·cm at room temperature. Further, the RF magnetron sputtered thin film method could also be used. The transparent can be higher than 82%. It is well known in the field of forming thin film. Under the cost and production consideration, the method for forming the antenna film, for example, indium tin oxide, could be formed at room temperature in wet atmosphere has an amorphous state, a desired pattern can be obtained at a high etching rate. After the film is formed and patterned, it is thermally treated at a temperature of about between 180 degree C. and 220 degree C. for about one hour to three hours to lower the film resistance and enhance its transmittance. Another formation is chemical solution coating method, as shown in FIG. 3. The coating solution includes conductive particles (prepared in step 310) having an average particle diameter of 1 to 25 μm, silica particles having an average particle diameter of 1 to 25 μm, and a solvent. The weight ratio of the silica particles to the conductive particles is preferably in the range of 0.1 to 1. The conductive particles are preferably metallic particles of one or more metals selected from Au, Zn, Ag, Pd, Pt, Rh, Ru, Cu, Fe, Ni, Co, Sn, Ti, In, Al, Ta, Ga, Ge and Sb. The conductive particles can be obtained by reducing a salt of one or more kinds of the aforesaid metals in an alcohol/water mixed solvent (step 300). Heat treatment (step 320), is performed at a temperature of higher than about 100 degree C. to provide thermal energy for chemical reaction between the silica and metallic particles to form the transparent conductive coating solution. The silica particles may improve the conductivity of the resulting conductive film. The metallic particles are approximately contained in amounts of 0.1 to 5% by weight in the conductive film coating liquid.

The transparent conductive film can be formed by applying the liquid on a substrate (step 330), drying it to form a transparent conductive particle layer (step 340), then applying the coating liquid for forming a transparent film onto the fine particle layer to form a transparent film on the particle layer (step 350). The coating liquid for forming a transparent conductive layer is applied onto a substrate by a method of dipping, spinning, spraying, roll coating, flexographic printing or the like and then drying the liquid at a temperature of room temperature to about 90 degree C. After drying, the coating film is curing by heated at a temperature of not lower than 100 degree C. or irradiated with an electromagnetic wave or in the gas atmosphere (step 360) to harden the thin film and lower the resistance.

The present invention disclosed fractal, monopole, dipole antenna configuration attached on at least one side of window, glass or windshield. In the embodiment of fractal antenna configuration, the structure is composed by a set of geometry pattern of the same class (the same number of sides or the same pattern dimension), being such the set of geometry pattern electromagnetically coupled either by means of an ohmic contact or a capacitive or inductive coupling mechanism. One transmission line is coupled to geometry pattern by means of either an ohmic contact or a capacitive or inductive coupling mechanism. The antenna features similar impedance at the feeding point in the multilevel bands. The geometry pattern is constructed and filled in the inside area of the geometry pattern, thereby forming a solid-shape structure with the transparent conducting material.

A moisture removal power source may be coupled to the antenna configuration via transmission line for providing heat to the pattern to remove fog or moisture on the glass or window. Thus, in some case, the configuration includes dual functions including receiving signal and acting as means for removing fog or moisture.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structure. While the preferred embodiment of the invention has been illustrated and described, it will be appreciated that various changes can be made therein without departing from the spirit and scope of the invention.

What is claimed is:

1. A method of forming an antenna for an object, wherein said antenna is formed by steps including:

preparing coating particles including metallic particles, silica particles, and a solvent;

heating said metallic particles, said silica particles and the solvent at a temperature higher than about 100 degree C. to form a coating solution;

coating said coating solution on a substrate to form a layer;

drying said layer to obtain an antenna pattern comprising an oxide containing metal, wherein said metal includes one or more metals selected from Au, Zn, Ag, Pd, Pt, Rh, Ru, Cu, Fe, Ni, Co, Sn, Ti, In, Al, Ta, Ga, Ge and Sb; and curing said antenna pattern by heat, irradiated with an electromagnetic wave or in a gas atmosphere.

2. The antenna of claim 1, wherein said conductive pattern includes koch pattern, Blackman-koch pattern, stochastic pattern, hexagonal pattern, lotus pods pattern, polygonal pattern, Sierpinski pattern, trapezoidal planar, battlements shape pattern or tree shape pattern.

3. The antenna of claim 1, wherein said conductive pattern futher includes silica particles for improving the conductively of said conductive pattern.

4. The antenna of claim 1, wherein said conductive pattern comprising:a plurality of basic motif elements attached partially on said object.

5. The conductive pattern of claim 1, wherein said object includes a vehicle windshield, a vehicle rearview mirror, vehicle rear light, vehicle break light, window of a building, notebook, mobile phone, portable device or vehicle head-light.

6. The conductive pattern claim 4, wherein said basic motif element includes square, rectangular, peak shape, line, triangular, hexagonal, circle, battlements shape or tree shape.

7. The method of claim 1, wherein said coating particles have an average particle diameter of 1 to 25 μm.

8. The method of claim 1, wherein a weight ratio of said silica particles to said metallic particles is preferably in the range of 0.1 to 1 .

9. The method of claim 1, wherein said metallic particles are obtained by reducing a salt of one or more kinds of metals in an alcohol/water mixed solvent.

10. The method of claim 1, wherein said metallic particles are approximately contained in amounts of 0.1 to 5% by weight in said coating solution.

11. The method of claim 1, wherein said layer is dried at a temperature of room temperature to about 90 degree C.

12. The method of claim 1, wherein said antenna pattern is cured at a temperature of not lower than 100 degree C.

* * * * *